US006488886B1

(12) United States Patent
Davis

(10) Patent No.: US 6,488,886 B1
(45) Date of Patent: Dec. 3, 2002

(54) CASTING LADLE

(76) Inventor: Daniel F. Davis, 2139 S. 30th St., Milwaukee, WI (US) 53215

( * ) Notice: Subject to any disclaimer, the term of this patent is extended or adjusted under 35 U.S.C. 154(b) by 6 days.

(21) Appl. No.: 09/802,539

(22) Filed: Mar. 9, 2001

(51) Int. Cl.[7] ..... C21B 3/00
(52) U.S. Cl. ..... 266/275; 432/263
(58) Field of Search ..... 266/275, 236; 432/263

(56) References Cited

U.S. PATENT DOCUMENTS 494,585 A * 4/1893 Mitchell ..... 266/275
1,493,373 A * 5/1924 Morgan ..... 266/275
2,650,255 A 8/1953 Hogel et al.
2,801,839 A * 8/1957 Lemmer ..... 432/263
2,948,522 A * 8/1960 Peters ..... 432/263
4,112,998 A 9/1978 Sato
4,324,392 A 4/1982 White et al.
D280,627 S 9/1985 Uram et al.
5,011,120 A * 4/1991 Bear ..... 266/275
5,370,372 A * 12/1994 Eckert ..... 266/275
5,758,714 A 6/1998 Sato et al.

* cited by examiner

*Primary Examiner*—Scott Kastler

(57) ABSTRACT

A casting ladle for improving the technique in the pour process of metallurgical molding. The casting ladle includes a bowl portion that has a bottom wall and a peripheral wall. The peripheral wall extends upwardly from a perimeter edge of the bottom wall such that the peripheral wall and the bottom wall define an interior space. The present invention has an open top such that the interior space is adapted for receiving molten metal. A spout outwardly extends from the peripheral wall such that the spout is adapted for controlling pouring of the molten metal.

4 Claims, 1 Drawing Sheet

CASTING LADLE

BACKGROUND OF THE INVENTION

1. Field of the Invention

The present invention relates to casting ladles and more particularly pertains to a new casting ladle for improving the technique in the pour process of metallurgical molding.

2. Description of the Prior Art

The use of casting ladles is known in the prior art. More specifically, casting ladles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,324,392; 5,011,120; 5,758,714; 4,112,998; 2,650,255; and U.S. Pat. No. Des. 280,627.

While these devices fulfill their respective, particular objectives and requirements, the aforementioned patents do not disclose a new casting ladle. The inventive device includes a bowl portion that has a bottom wall and a peripheral wall. The peripheral wall extends upwardly from a perimeter edge of the bottom wall such that the peripheral wall and the bottom wall define an interior space. The present invention has an open top such that the interior space is adapted for receiving molten metal. A spout outwardly extends from the peripheral wall such that the spout is adapted for controlling pouring of the molten metal.

In these respects, the casting ladle according to the present invention substantially departs from the conventional concepts and designs of the prior art, and in so doing provides an apparatus primarily developed for the purpose of improving the technique in the pour process of metallurgical molding.

SUMMARY OF THE INVENTION

In view of the foregoing disadvantages inherent in the known types of casting ladles now present in the prior art, the present invention provides a new casting ladle construction wherein the same can be utilized for improving the technique in the pour process of metallurgical molding.

The general purpose of the present invention, which will be described subsequently in greater detail, is to provide a new casting ladle apparatus and method which has many of the advantages of the casting ladles mentioned heretofore and many novel features that result in a new casting ladle which is not anticipated, rendered obvious, suggested, or even implied by any of the prior art casting ladles, either alone or in any combination thereof.

To attain this, the present invention generally comprises a bowl portion that has a bottom wall and a peripheral wall. The peripheral wall extends upwardly from a perimeter edge of the bottom wall such that the peripheral wall and the bottom wall define an interior space. The present invention has an open top such that the interior space is adapted for receiving molten metal. A spout outwardly extends from the peripheral wall such that the spout is adapted for controlling pouring of the molten metal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new casting ladle apparatus and method which has many of the advantages of the casting ladles mentioned heretofore and many novel features that result in a new casting ladle which is not anticipated, rendered obvious, suggested, or even implied by any of the prior art casting ladles, either alone or in any combination thereof.

It is another object of the present invention to provide a new casting ladle, which may be easily and efficiently manufactured and marketed.

It is a further object of the present invention to provide a new casting ladle, which is of a durable and reliable construction.

An even further object of the present invention is to provide a new casting ladle which is susceptible of a low cost of manufacture with regard to both materials and labor, and which accordingly is then susceptible of low prices of sale to the consuming public, thereby making such casting ladle economically available to the buying public.

Still yet another object of the present invention is to provide a new casting ladle which provides in the apparatuses and methods of the prior art some of the advantages thereof, while simultaneously overcoming some of the disadvantages normally associated therewith.

Still another object of the present invention is to provide a new casting ladle for improving the technique in the pour process of metallurgical molding.

Yet another object of the present invention is to provide a new casting ladle which includes a bowl portion that has a bottom wall and a peripheral wall. The peripheral wall extends upwardly from a perimeter edge of the bottom wall such that the peripheral wall and the bottom wall define an interior space. The present invention has an open top such that the interior space is adapted for receiving molten metal. A spout outwardly extends from the peripheral wall such that the spout is adapted for controlling pouring of the molten metal.

Still yet another object of the present invention is to provide a new casting ladle that improves safety for the user in that the present invention eliminates the need for a foundry to fabricate and fit its one handle. The present invention also minimizes the risk of splashes and spills through its unique design.

Even still another object of the present invention is to provide a new casting ladle that reduces the precision with which a ladle is required to be held to achieve slow-fast-slow flow rates. The present invention prevents air entrapment within the mold as well as allowing for optimal flow rate, maintaining porosity and grain size.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
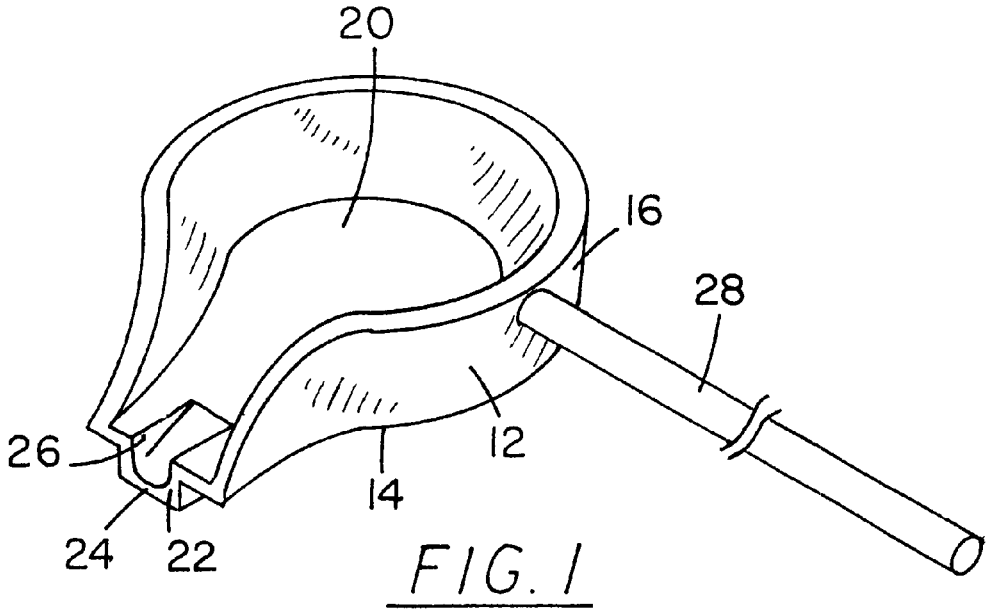
FIG. 1 is a perspective view of a new casting ladle according to the present invention.
Figure 2:
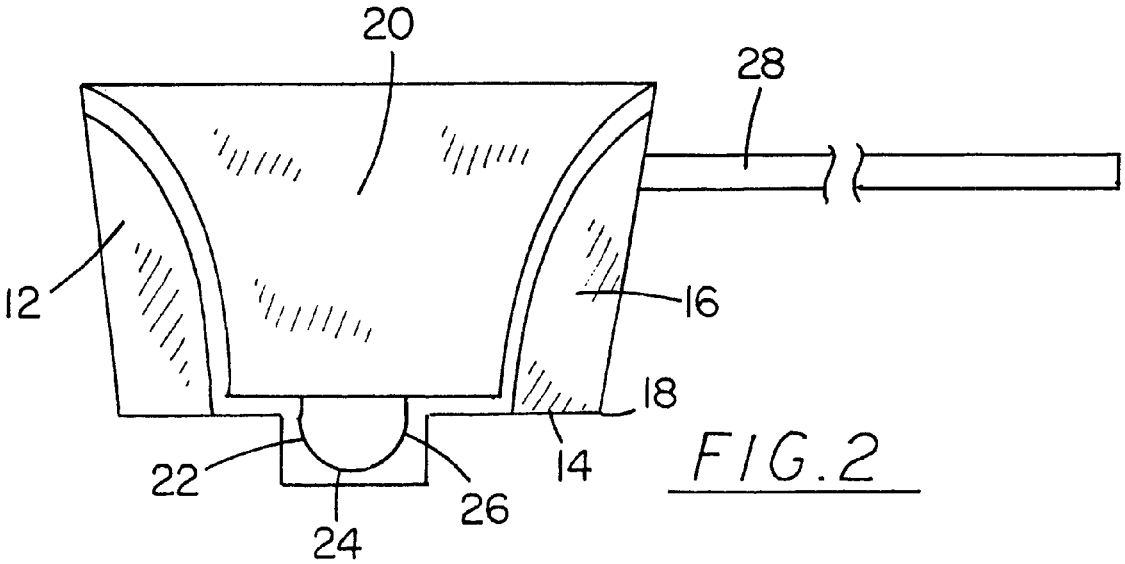
FIG. 2 is a side view of the present invention.

With reference now to the drawings, and in particular to FIGS. 1 through 2 thereof, a new casting ladle embodying the principles and concepts of the present invention and generally designated by the reference numeral 10 will be described.

As best illustrated in FIGS. 1 through 2, the casting ladle 10 generally includes a bowl portion 12 that has a bottom wall 14 and a peripheral wall 16. The peripheral wall 16 extends upwardly from a perimeter edge 18 of the bottom wall 14 such that the peripheral wall 16 and the bottom wall 14 define an interior space 20. The present invention has an open top such that the interior space 20 is adapted for receiving molten metal. A spout 22 outwardly extends from the peripheral wall 16 such that the spout 22 is adapted for controlling pouring of the molten metal.

The spout 22 has a channel 24 and a pair of side portions 26. Each of the side portions 26 is positioned between the channel 24 and the peripheral wall 16. The side portions 26 are substantially coplanar such that the side portions 26 are adapted for permitting the molten metal to be poured from the bowl portion 12. The channel 24 outwardly extends from the side portions 26 such that the channel 24 is adapted for facilitating precise pouring of the molten metal from the bowl portion 12.

The channel 24 of the spout 22 has a substantially arcuate cross-section taken transverse to a longitudinal axis of the channel 24 such that arcuate cross-section of the channel 24 is adapted for reducing the amount of air trapped in the molten metal when the molten metal is poured from the bowl portion 12.

A handle 28 outwardly extends from the peripheral wall 16 such that the handle 28 is adapted for facilitating pouring of the molten metal from the bowl portion 12.

In use, a user would use the present invention to improve the technique in the slow-fast-slow pour process of metallurgical molding. Specifically it is an improved ladle, which reduces trapped air increasing product quality and reducing scrap. Through the present inventions improved spout and handle the ladle improves the pouring of molten metal.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and-described, and accordingly, all suitable modifications and equivalents may be resorted to, falling within the scope of the invention.

I claim:

1. A casting ladle for pouring molten metal comprising:

a bowl portion having a bottom wall and a peripheral wall, said peripheral wall extending upwardly from a perimeter edge of said bottom wall such that said peripheral wall and said bottom wall define an interior space having an open top such that said interior space is adapted for receiving molten metal;

a spout outwardly extending from said peripheral wall such that said spout is adapted for controlling pouring of the molten metal; and said spout having a channel and a pair of side portions, each of said side portions are positioned between said channel and said peripheral wall, said side portions being substantially coplanar such that said side portions are adapted for permitting the molten metal to be poured from said bowl portion, a top surface of said side portions being aligned with an interior surface of said bottom wall of said bowl portion such that said side portion are adapted for permitting molten metal to be poured directly from said bottom wall of said bowl portion, said channel outwardly extending from said top surface of said side portions such that said channel is positioned below said interior surface of said bottom wall, said channel of said spout being adapted for facilitating precise pouring of the molten metal from the bowl portion.

2. The casting ladle as set forth in claim 1, wherein said channel of said spout has a substantially arcuate cross-section taken transverse to a longitudinal axis of said channel such that arcuate cross-section of said channel is adapted for reducing the amount of air trapped in the molten metal when the molten metal is poured from the bowl portion.

3. The casting ladle as set forth in claim 1, further comprising:

a handle outwardly extending from said peripheral wall such that said handle is adapted for facilitating pouring of the molten metal from said bowl portion.

4. A casting ladle for pouring molten metal comprising:

a bowl portion having a bottom wall and a peripheral wall, said peripheral wall extending upwardly from a perimeter edge of said bottom wall such that said peripheral wall and said bottom wall define an interior space having an open top such that said interior space is adapted for receiving molten metal; and a spout outwardly extending from said peripheral wall such that said spout is adapted for controlling pouring of the molten metal;

wherein said spout has a channel and a pair of side portions, each of said side portions are positioned between said channel and said peripheral wall, said side portions being substantially coplanar such that said side portions are adapted for permitting the molten metal to be poured from said bowl portion, a top surface of said side portions being aligned with an interior surface of said bottom wall of said bowl portion such that said side portion are adapted for permitting molten metal to be poured directly from said bottom wall of said bowl portion, said channel outwardly extending from said top surface of said side portions such that said channel is positioned below said interior surface of said bottom wall, said channel of said spout being adapted for facilitating precise pouring of the molten metal from the bowl portion;

wherein said channel of said spout has a substantially arcuate cross-section taken transverse to a longitudinal axis of said channel such that arcuate cross-section of said channel is adapted for reducing the amount of air trapped in the molten metal when the molten metal is poured from the bowl portion;

wherein a handle outwardly extending from said peripheral wall such that said handle is adapted for facilitating pouring of the molten metal from said bowl portion.

* * * * *